US007152969B2

(12) United States Patent
Hintermann

(10) Patent No.: US 7,152,969 B2
(45) Date of Patent: Dec. 26, 2006

(54) METHOD OF PRINTING USING PARTIAL CURING BY UV LIGHT

(75) Inventor: Kilian Hintermann, Dürrenasch (CH)

(73) Assignee: Luscher Hans, Lenzberg (CH)

( * ) Notice: Subject to any disclaimer, the term of this patent is extended or adjusted under 35 U.S.C. 154(b) by 262 days.

(21) Appl. No.: 10/733,764

(22) Filed: Dec. 12, 2003

(65) Prior Publication Data

US 2004/0189770 A1 Sep. 30, 2004

(30) Foreign Application Priority Data

Dec. 12, 2002 (CH) ..... 2122/02

(51) Int. Cl.
*B41J 2/01* (2006.01)
*B41J 2/51* (2006.01)

(52) U.S. Cl. ..... 347/102; 347/41

(58) Field of Classification Search ..... 347/102, 347/41

See application file for complete search history.

(56) References Cited

U.S. PATENT DOCUMENTS

| | | | | |
|---|---|---|---|---|
| 5,592,202 | A | 1/1997 | Erickson | |
| 6,092,890 | A | 7/2000 | Wen et al. | |
| 6,145,979 | A | 11/2000 | Caiger et al. | |
| 6,443,554 | B1 * | 9/2002 | Yoshida | 347/41 |
| 6,457,823 | B1 | 10/2002 | Cleary et al. | |
| 6,786,589 | B1 * | 9/2004 | Suzuki et al. | 347/102 |
| 2001/0030672 | A1 | 10/2001 | Gudaitis et al. | |

FOREIGN PATENT DOCUMENTS

| | | |
|---|---|---|
| EP | 0 554 907 | 8/1993 |
| EP | 1 108 553 A1 | 6/2001 |
| EP | 1 160 084 | 12/2001 |
| WO | WO 02/14073 | 2/2002 |
| WO | WO 02/078958 A1 | 10/2002 |

* cited by examiner

*Primary Examiner*—Hai Pham
*Assistant Examiner*—Carlos A. Martinez
(74) *Attorney, Agent, or Firm*—Stuart I. Smith; Venable LLP

(57) ABSTRACT

A method for digital printing is provided. The method includes selective printing of selected dots in a first matrix of dots in a selected color, which dots are spaced apart by a distance which exceeds the dot size; partial curing of the print droplets by UV light; selective printing of selected dots of a second matrix of intermediate dots in X-direction, in each case using the same color, partial curing of these intermediate dots using UV light; advanding the material to be printed in Y-direction; selective printing of selected dots of a third matrix of intermediate dots, in relation to the first or second matrix, in Y-direction in the selected color; partial curing of the print droplets by UV light; selective printing of selected dots of a foourth matrix of intermediate dots in X-direction, in relation to the third matrix, in the selected color; partial curing of these intermediate dots, using UV light; advancing the material; repeating these steps until the print image is generated on the material in the selected color; and curing all the dots, using a curing UV light-source.

2 Claims, 6 Drawing Sheets

METHOD OF PRINTING USING PARTIAL CURING BY UV LIGHT

Figure 1:
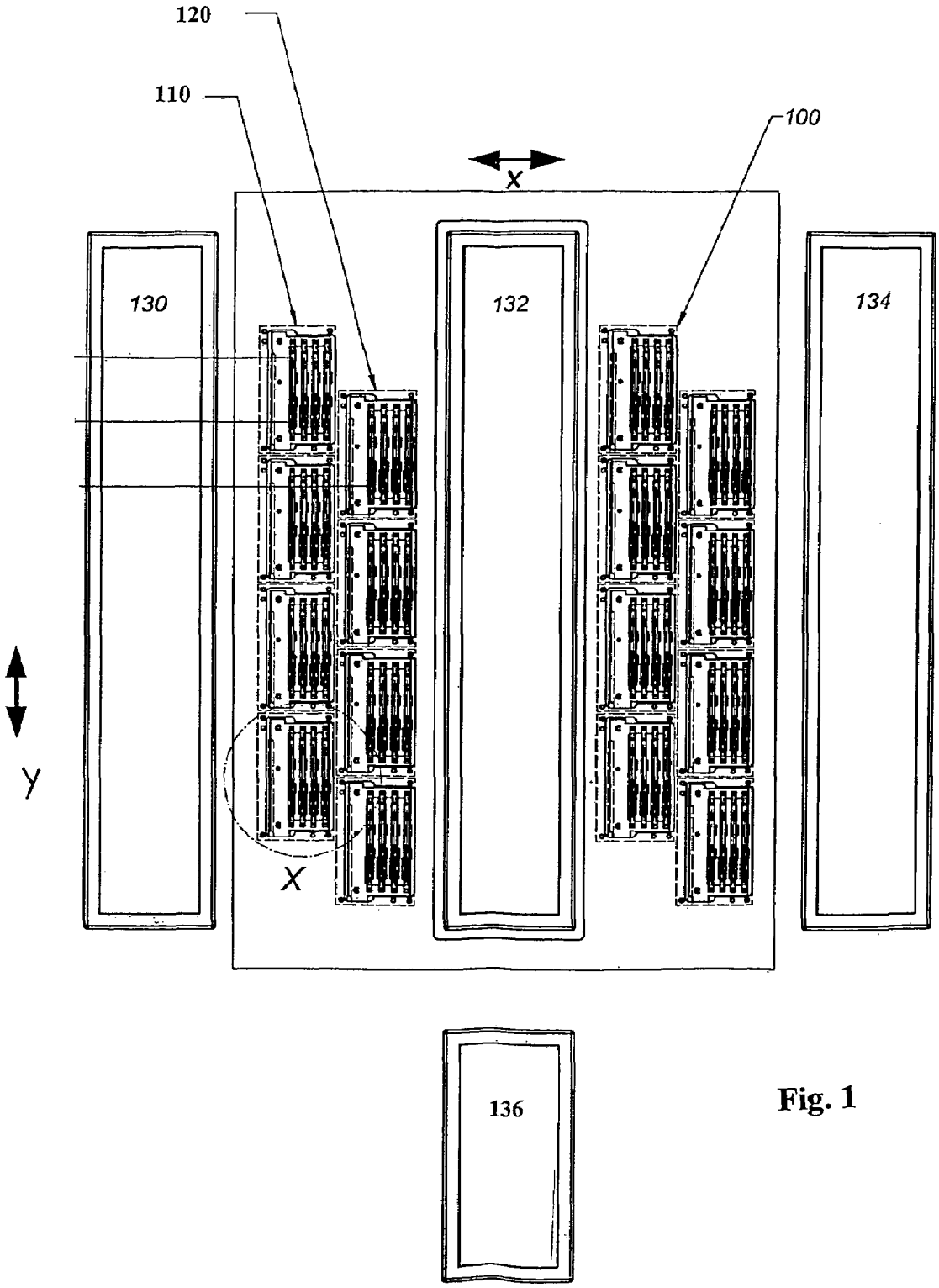

The invention relates to a printing device, in particular the printing unit for printing with drop-on-demand ink-jet technology, with the ink, after having been printed onto a suitable substrate, being cured with the light of an ultraviolet light-source. According to the second aspect, the invention relates to a corresponding method.

The printing industry is the principal area of application, where so-called digital printing, in particular on large areas, plays an important role. Digital printing is advantageous when compared for example with conventional screen printing, in that areas of almost any desired dimensions can be printed upon, without there being any need for a pre press. In this process the UV-cured ink, having been applied by the ink-jet printer to the surface to be printed, is cured and fixed by means of a UV light-source so that further ink droplets to be applied cannot run into those applied previously. This well-known method is in contrast to that of using solvent inks, in which an organic solvent or simply a solvent containing water has to dry out accordingly. The method is also in contrast to the method of using so-called hot-melt inks in which the ink is kept liquid by an increase in its temperature while it is applied by the ink-jet printer to the surface to be printed, before being cured by cooling.

Basically, three different types of digital printers for use with UV-curing ink are known, namely: flat bed printers (X-Y), unidirectional continuous drum printers, and roll-to-roll printers. Flat bed printers have a special characteristic in that they are capable of easily printing materials which cannot be rolled, e.g. glass, acrylic glass etc. The present invention is to be designed such that it is equally suitable for any such printer types.

Typical inks of this type, i.e. very fast drying colours, include Crystal UGE UV-curing jet ink by Sun Jet, which provides good adhesion to various materials, in particular to plastic, with very little shrinking during curing.

Digital printing devices known from the state of the art, at any rate in the case of printing devices which produce coloured print by means of several differently-coloured inks applied one on top of the other, mostly comprise a multitude of print heads arranged in a row. The Inca-Eagle device, for example, comprises 2×4 matrices to which ink of a particular colour is fed. In this design, the arrangement comprising the print heads is moved in one direction (in this document referred to as the X-direction) over the material to be printed, while in the other direction (in this document referred to as the Y-direction), after printing with a print line, the material is advanced, as described using the example of the above-mentioned continuous printer. However, in order to achieve high $m^2$-performance (as many jets as possible, all simultaneous), according to FIGS. 2*a* to 2*d*, printing takes place according to the so-called interlace method both in the X-direction and in the Y-direction, in which interlace method first the droplets are applied such that they do not run into each other but still do not result in a complete print image, and then, after fixing (which prevents running) intermediate droplets are placed. A print-droplet density of 90 to 1200 dpi (droplets per inch, i.e. per 25.4 mm, with a droplet volume of 5 to 150 pl) is typical, which corresponds to a metric value of 70 μm per printing droplet. It is imaginable and indeed usual that the print head rows are laterally adjacent to UV light-sources, which, after the ink has been applied, fix said ink.

In principle, the above-mentioned process and the associated device are suitable for implementing a digital printing method. However, it has been shown that the print speed plays a significant role in large-area printing processes. First attempts at increasing the print speed have been made e.g. by increasing the number of the print heads or the jets on each print head. In trials for example, 8192 jets per print head have been used. However, it has been shown that from the point of view of economics and logistics it is more favorable to arrange print heads in lines of 128 or 256 jets. This is not only because, should replacement of the print heads become necessary, the cost would be reduced, but also because the probability of a fault occurring in a single print head is smaller than if, for example, there are 8192 jets per print head. In principle, increasing the processing speed provides a further possibility for solving the problem described above. However, such an increase in processing speed is limited by the fixing process between the individual print droplets, because the running of droplets into each other is to be avoided in every case. The plotting performance depends on the number of jets, on the plotting frequency, and on minimization of idle time, which is defined as the time in which the jets are not ejecting ink.

It is thus the object of the present invention to propose a device and a corresponding printing method which make do with print heads comprising a relatively small number of jets, while providing a rapid sequence of droplet delivery.

According to the invention, this object is met according to a first aspect in that a device with the characteristics of the independent claim 1 is proposed. In this arrangement, the measures of the invention first result in that, with a small UV output, the droplets are not completely cured during fixing, but only partially cured to a small extent, but nevertheless to an extent necessary to prevent running of droplets into each other, with the entire printed image being cured later.

In this document, the term "partially cure(d)" or "partial curing" refers to stopping the process of the droplets running into each other, with such running being different depending on the surface tension of the material to be printed upon. By "digital" partial curing, a smaller quantity of light is thus applied, and with it the surface of the droplet is solidified; hence this process is stopped. After partial curing, the surface tension no longer plays any role, which results in an advantage in that materials which differ widely can be treated in the same way. The interior of the droplet remains at least partly liquid, and there is sufficient time for wetting the surface of the material.

By contrast, the term "curing" or "complete curing" refers to the ink which has been applied in droplet form being completely cured. All the photo indicators react, and the liquid (ink) becomes a solid material, typically by way of polymerization. This requires the higher UV intensity provided by the curing light-source.

Advantageously, print heads with e.g. 128 or 256 jets are used, without significant reductions in the print speed having to be accepted.

According to a second aspect, the object is met in that a method with the characteristics of the independent method-related claim is proposed.

Further aspects of the invention are provided in the other claims.

The above-mentioned elements as well as the elements claimed and described in the following embodiments, which elements are to be used according to the invention, are not subject to any particular exceptional conditions as far as their size, shape, use of material or technical concept are concerned so that the selection criteria known in the respective area of application can be applied without any limitations.

In this document, the term "UV light-source" refers not only to a UV lamp, e.g. a mercury discharge lamp, but also to any LED light-source or any other light-source, without this having a significant influence on the invention or the ability to implement it.

Further details, characteristics and advantages of the object of the invention are provided in the subsequent description of the associated drawings in which, by way of an example, a printing device and an associated method-related sequence is explained in the context of the present invention.

Figure 2:
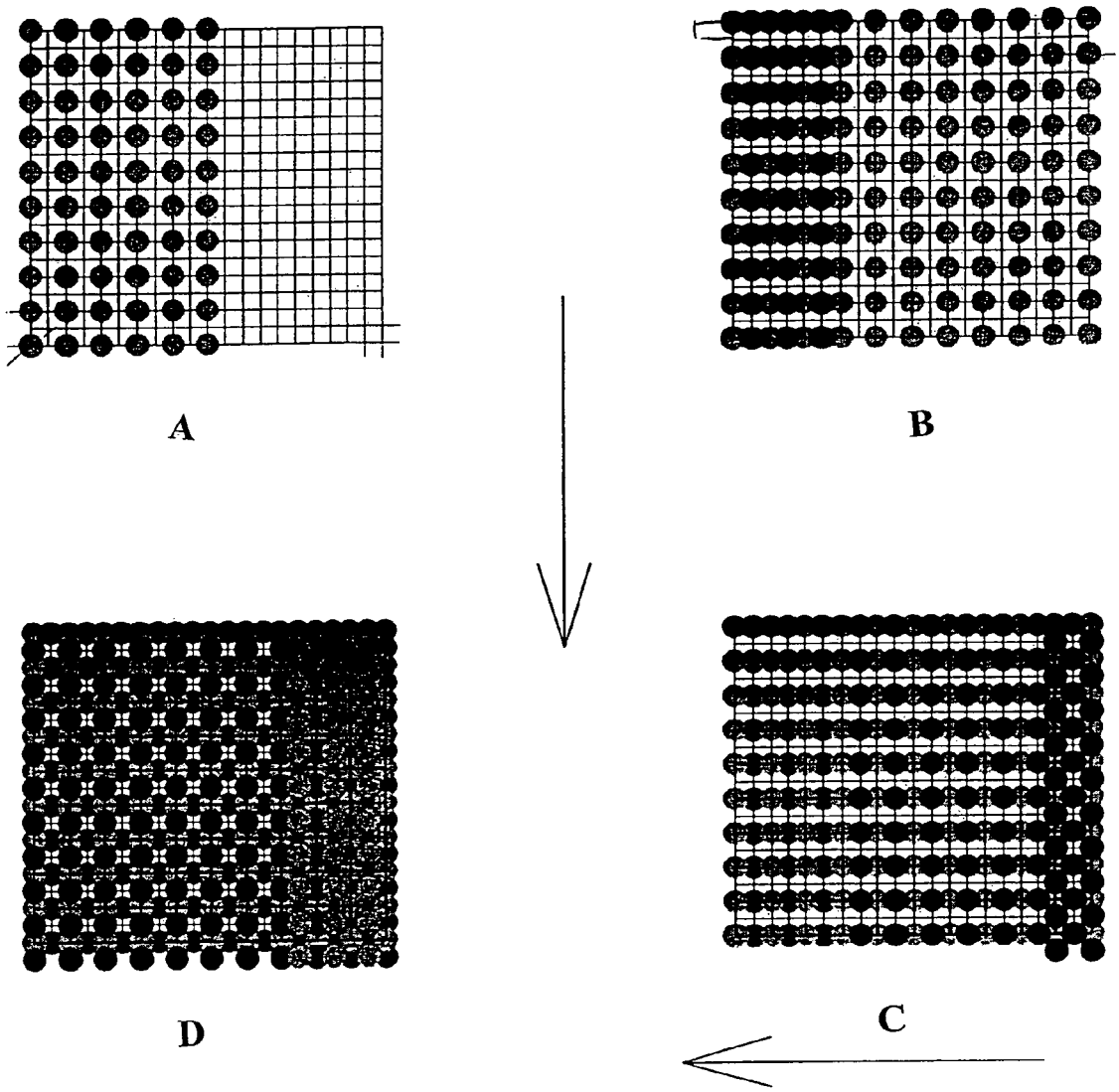
Figure 3:
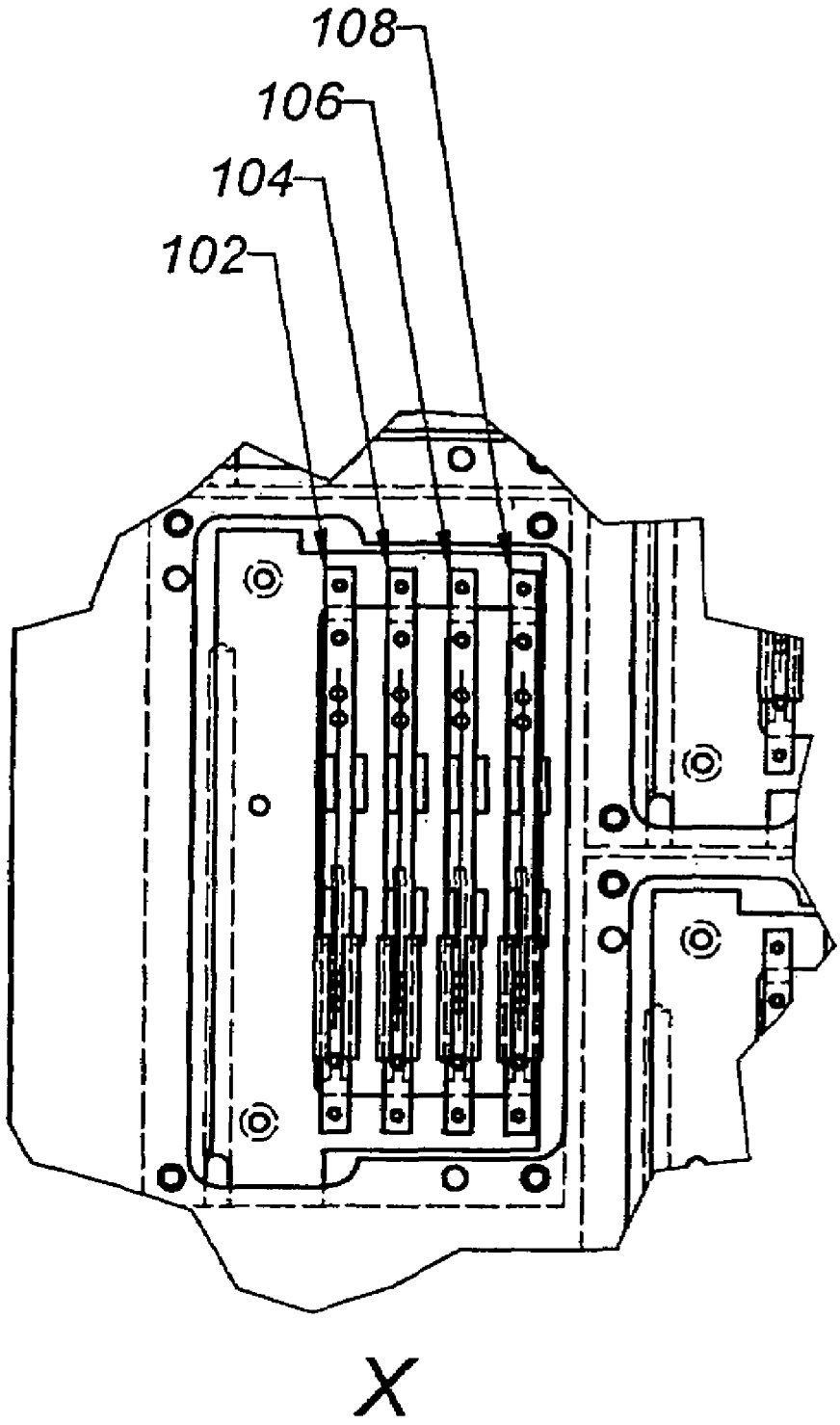
Figure 4:
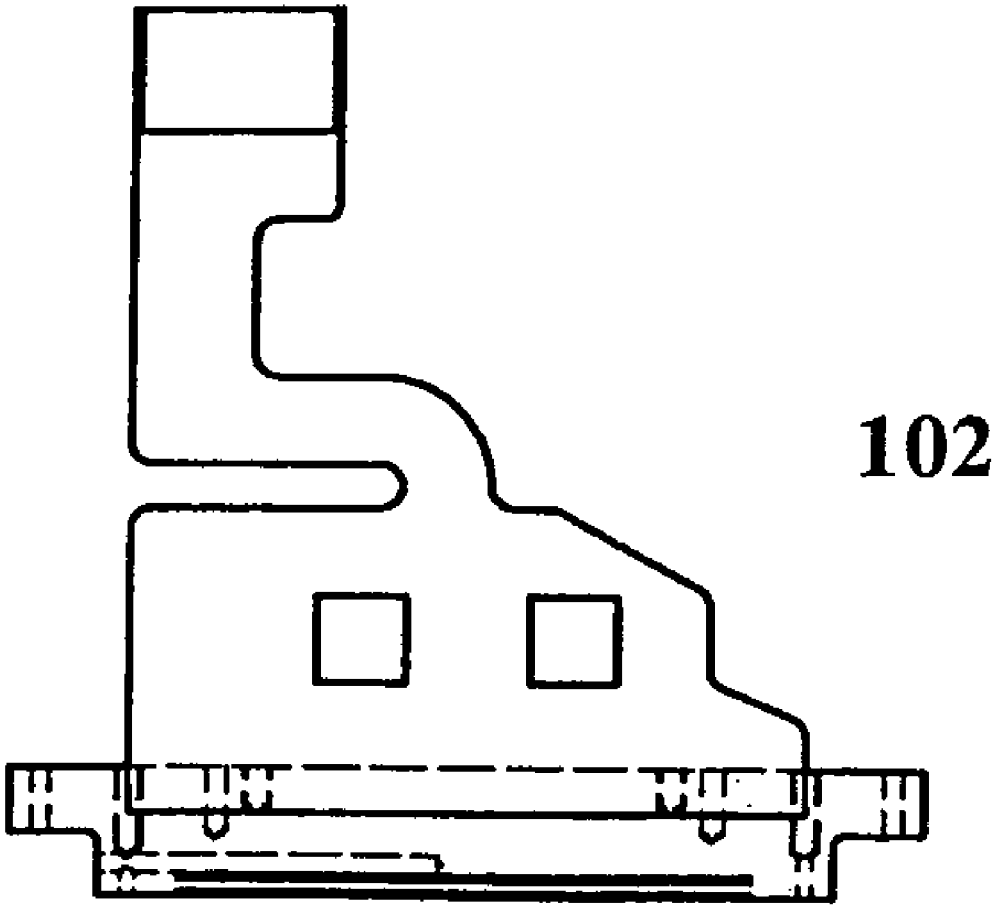
Figure 5:
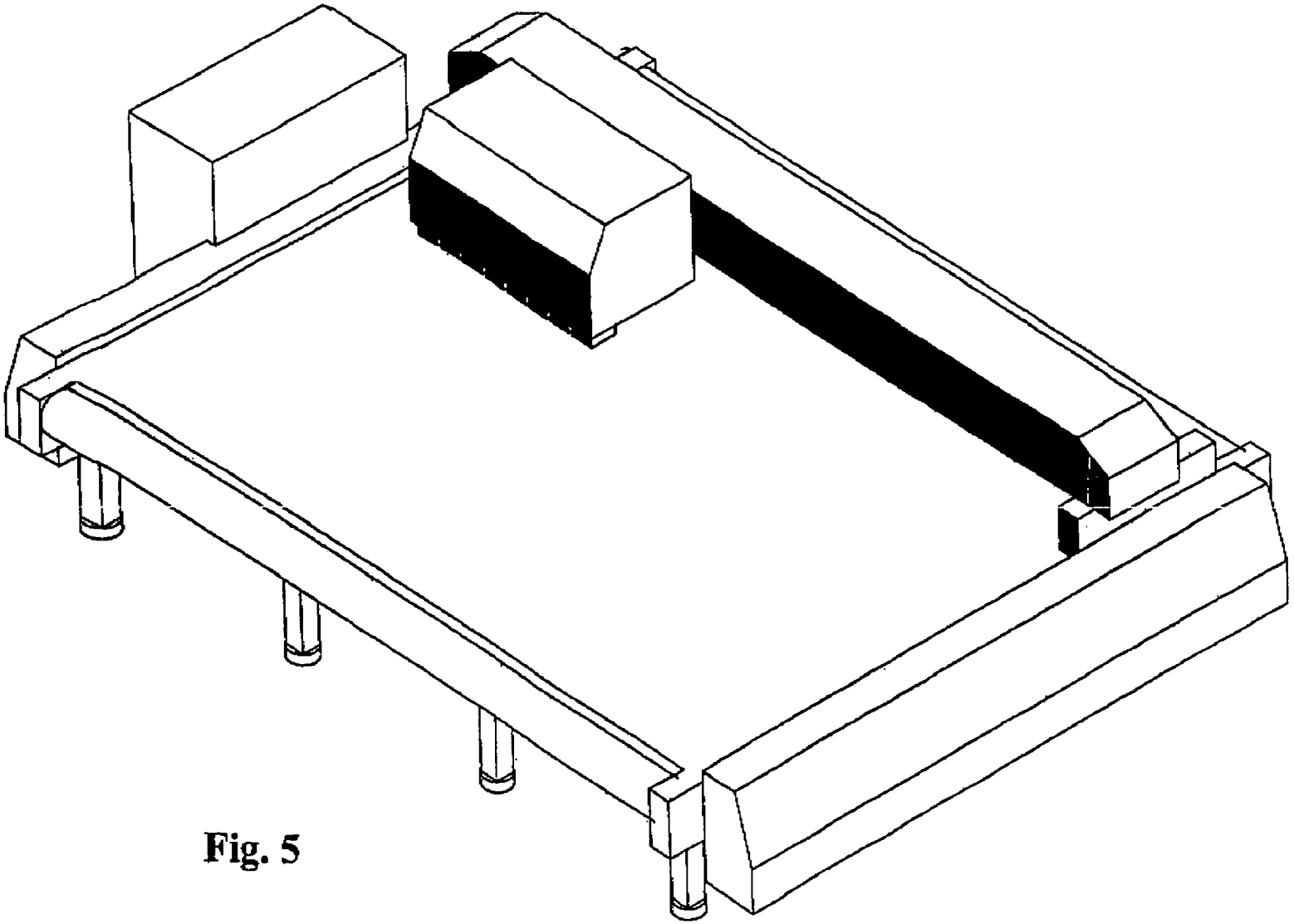

The following are shown in the drawings:

FIG. 1 a diagrammatic view of the arrangement according to the present invention;

FIG. 2 parts A, B, C and D of the figure show a possible diagrammatic flow chart comprising some intermediate steps for a typical "interlaced" method during digital printing with temporary partial curing;

FIG. 3 a detailed drawing of a print head arrangement being a section of FIG. 1;

FIG. 4 a representation of a print head;

FIG. 5 an overall view of the digital printing machine; and

Figure 6:
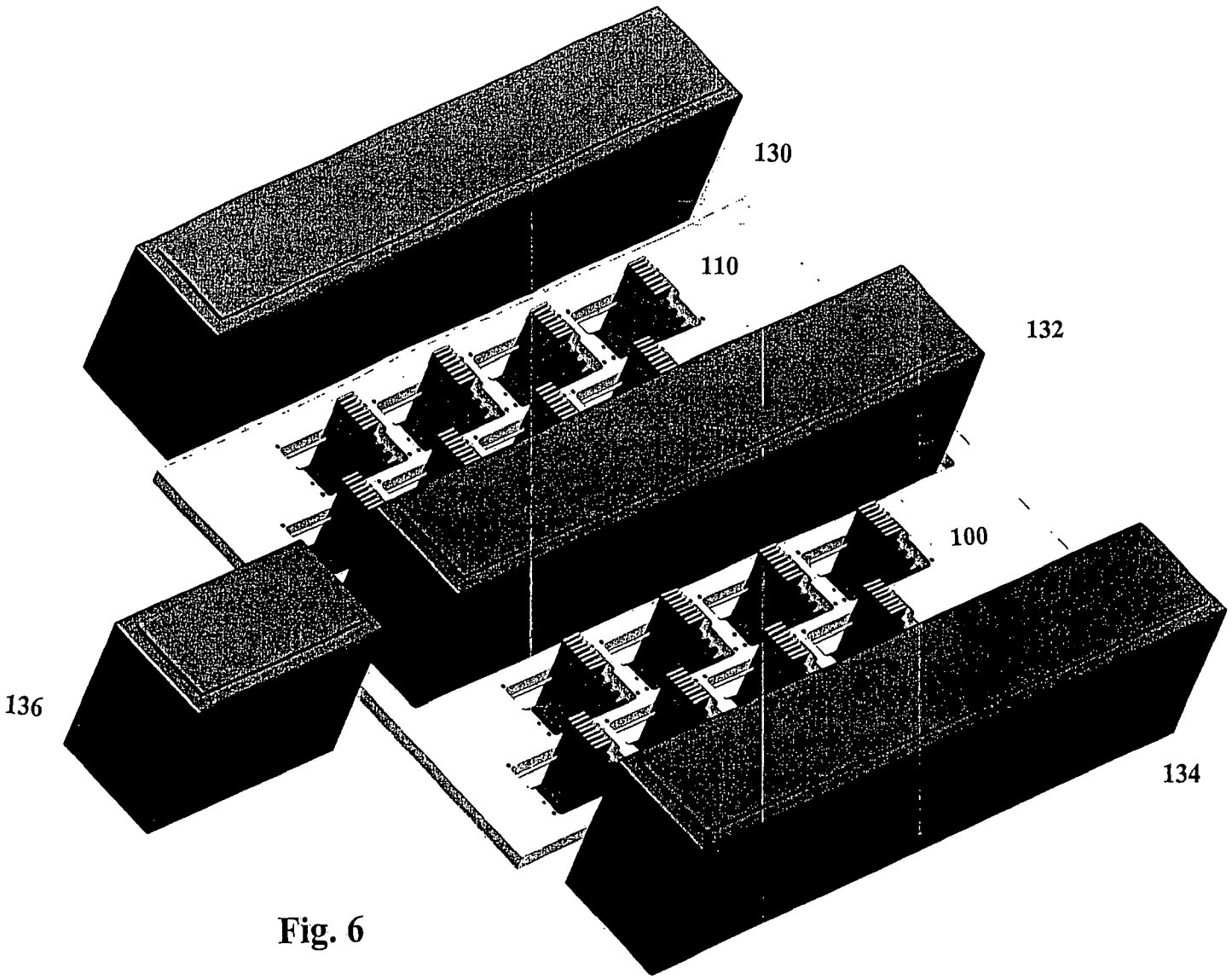

FIG. 6 a 3-D view of the printing machine according to FIG. 5.

FIG. 1 shows a preferred arrangement of print head blocks and UV light-sources according to the present invention. In this arrangement, in each case 4 print heads 102, 104, 106, 108, each with 128 or 256 jets, are arranged side-by-side in X-direction, in FIG. 1 designated 100, wherein the print heads of these lines are precisely aligned; in the present embodiment (resolution 4×50 dpi=200 dpi) they are spaced apart from each other by 15 mm. Four such rows 100 are aligned in Y-direction, arranged one behind the other, wherein the spacing between the last print heads of the preceding line and the first print head of the new line corresponds to the length of a print head line. In the present embodiment, these 16 print heads constitute a first print head block 110. Arranged beside this first print head block 110, in X-direction, is a second print head block 120, which in Y-direction is offset by the length of a print head line.

UV light-source lines 130 and 132 are arranged to the left and right of the first and second print head blocks, with the lines in their length in Y-direction protruding somewhat beyond the print heads; in the embodiment shown they protrude by approx. 15 mm.

In the preferred embodiment, the previously-described arrangement is supplemented by a further arrangement of identical design, wherein one of the UV light-source lines 132 constitutes the right line of the first arrangement, and the left line of the second arrangement. In other words, the device according to this embodiment comprises three UV light-source rows 130, 132, and 134 for partial curing. Of course, the middle UV light-source, i.e. the UV light-source which constitutes the right source for one block and the left source for the other block, exists only once.

In this embodiment, for curing in X-direction, a curing light-source 136 for the UV light is movably arranged, behind the print arrangement, on said print arrangement, so that for the purpose of curing, the UV light can be guided quasi line-by-line across the print surface that has been completed so far.

In the embodiment shown, for the purpose of curing, an intensity ranging from 15 to 25 watts/cm, preferably of 20 watts/cm (reflector lamp energy) at a dose of 50 to 100 mJ/cm2 at a layer thickness of 12 pm has been provided. In this arrangement, the use of inks which are reactive between approx. 250 and 420 nm is intended; such inks are supplied by the manufacturer Sun Jet, Crystal UDG. The spectrum of the mercury discharge lamp which has been provided for this arrangement is between 280 and 410 nm.

In the embodiment described, an intensity of between 80 and 160 watts/cm (reflector lamp energy) is used for curing, with the dose being between approx. 200 and 1000 mJ/cm2. In the embodiment presently described, the spectral values of the light-sources in the case of the curing light-source 136 are equivalent to those of the partial-curing light-sources 130, 132, and 134.

Of course, these values have to be adapted if inks are used which differ from the inks described in the present embodiment.

The method for operating such a device is as follows, as shown in FIG. 2:

In the present embodiment, the physical resolution of the print head is 50 dpi. By way of four rows (4×50 dpi=200 dpi), arranged so as to be offset, a first matrix of dots is printed in a first colour, which dots are spaced apart by a distance which exceeds the dot size; in the present case according to partial view a in FIG. 2 a dot density of 200 dpi. Printing takes place in that the printing device according to the present invention is guided in X-direction over the material to be printed. In each instance, the print head lines, arranged side-by-side, which print head lines in the present embodiment contain ink of the same colour, thus print four dots situated beside each other. Subsequently, the respective droplet is partially cured by means of the middle UV light-source 132 so that there is no longer any risk of the ink running. Subsequently, each of the parallel print heads of the other print half prints an intermediate droplet of the same colour, applied between the two previously applied droplets (interlaced application), with said intermediate droplet then also being partially cured by the left UV light-source 130. The material to be printed is advanced by half the length of the distance of the jets within the print head. The previously described process is repeated for the intermediate line, in that first a line with dots with large spacing is printed, then the dots are partially cured by means of the UV light-source 132, and then the intermediate dots of this intermediate line are printed and partially cured with the UV light-source 134.

Of course, the jets of the print heads are only activated if printing is intended at the respective position on the material (digital printing).

After printing with the first colour component has been carried out, the material is advanced by the length of a print head, and the printing process is carried out in the same way at the above-mentioned position, using a second colour component, while the device for the length of a print head further commences to print the print image for the first colour. This sequential process is repeated until all the print heads are in action. After this, on the first strip, whose width measures one length of the print head, printing of the material with up to eight colours (1 . . . 8) is complete, while for the last colour intended, only the first strip has been printed. This process can be described as a sequential activation of the print colours. To obtain improvements in the print quality, other writing strategies are also possible; however, printing according to the interlacing process with partial curing and subsequent complete curing remains the basic principle in all of these strategies.

Furthermore, the material is sequentially printed in strips until the first print head reaches the end of the material. In this case, sequential deactivation of the print colours is carried out in that in each instance the print heads are no longer used for one colour. The print image is complete after the last print head has printed the last colour on the material.

In this embodiment, the partial curing light-source for the UV light, for partial curing in the X-direction, is guided quasi line-by-line over the printed area which has been completed so far, thus in each instance completing a line. It should be emphasised that a line can and will be of different width than the width mentioned above, i.e. a line comprises a multitude of dots.

The method described above shows that the selected arrangement of print heads is an ideal compromise between the demand for having as many printing processes proceed in parallel and the disadvantages which result from the therefore necessary—in this case sequential—activation and deactivation of the print heads if, in an individual case, printing (measured in Y-direction) is only to take place over a short distance.

The invention claimed is:

1. A method for digital printing, in particular comprising a printing device in several colours, the printing device comprising:

a multitude of print head devices (clusters) which can be moved in a first direction (X) over the material to be printed, in each case with a multitude of arrangements of piezotechnical printing elements in one line (jetting assemblies), arranged side-by-side, and at least one UV light-source arrangement (130, 132, 134) to the side of the moveable print head devices (clusters) for admitting UV light to ink which cures by exposure to UV light, wherein the alignment (Y) of each arrangement is essentially in vertical direction, in which the print head devices (clusters) are movable (X);

in each of the print head devices (clusters) the arrangements, that are arranged side-by-side, of printing elements in one line (jetting assemblies) are in each case offset by a micro-step in the direction (Y) of the line;

the UV light-source arrangement (130, 132, 134), of which there is at least one, is movable together with the print head devices (clusters);

the UV light-source arrangement (130, 132, 134), of which there is at least one, is designed such that it is suitable for partially curing the ink without completely curing it; and furthermore, the printing device comprises a further UV-curing light-source arrangement (136) for curing the ink;

wherein printing in each selected colour is carried out in the following steps:

(A) selective printing of selected dots in a first matrix of dots in the selected colour, which dots are spaced apart by a distance which exceeds the dot size, by means of the print head lines of the first print half, which print head lines are located side by side between two UV light-sources;

(B) partial curing of the print droplets by means of middle UV light-source (132);

(C) selective printing of selected dots of a second matrix of intermediate dots in X-direction with the parallel print heads of the other print half, in each case using the same colour;

(D) partial curing of these intermediate dots, using a first outer UV light-source (130);

(E) advancing the material to be printed in Y-direction by half the length of the distance between the jets within a jet head line;

(F) selective printing of selected dots of a third matrix of intermediate dots, in relation to the first or second matrix, in Y-direction in the selected colour, using the print heads of the second print half;

(G) partial curing of the print droplets by means of the middle UV light-source (132);

(H) selective printing of selected dots of a fourth matrix of intermediate dots in X-direction, in relation to the third matrix, in the selected colour, using the print heads of the first print half;

(I) partial curing of these intermediate dots, using a second outer UV light-source (134);

(J) advancing the material by the length of a print head line;

(K) repeating steps (A) to (I) until the print image is generated on the material in the selected colour; and (L) curing all the dots, using a curing UV light-source (136);

wherein printing takes place according to steps (A) to (I), at first in a first colour, and then at each repeat step (K) printing is added in a further colour, until print as been applied in all colours.

2. The method for printing according to claim 1, whereby at the end of the material to be printed, first printing of the first colour and then printing of subsequent colours in turn is completed.

* * * * *